United States Patent [19]

Buchek

[11] 4,066,155

[45] Jan. 3, 1978

[54] DRAWER TYPE LUGGAGE

[75] Inventor: Francis Z. Buchek, Watertown, Conn.

[73] Assignee: The Raymond Lee Organization, Inc., New York, N.Y.

[21] Appl. No.: 708,321

[22] Filed: July 26, 1976

[51] Int. Cl.[2] ..... A47B 61/06

[52] U.S. Cl. ..... 190/3; 232/43.2; 312/107; 190/58 B; 190/41 R

[58] Field of Search ..... 190/1, 3, 6, 21, 58 B, 190/41 R; 312/107, 111; 229/11, 20; 206/511; 232/43.1, 43.2

[56] References Cited

U.S. PATENT DOCUMENTS

| | | | |
|---|---|---|---|
| 623,642 | 4/1899 | Wallen | 232/43.2 |
| 1,860,586 | 5/1932 | McIlhenney | 229/11 UX |
| 3,113,651 | 12/1963 | Szabo | 190/58 B |
| 3,795,941 | 3/1974 | Szabo | 190/58 B X |
| 3,941,247 | 3/1976 | Cripe | 206/511 |
| 3,974,898 | 8/1976 | Tullis | 190/3 |

*Primary Examiner*—Donald F. Norton
*Attorney, Agent, or Firm*—Howard I. Podell

[57] ABSTRACT

A portable carrying case fitted with a slidable drawer, with the front face of the drawer forming a first external side of the case in the closed drawer position and fitted on a second adjacent exterior side of the case with a retractable carrying handle that fits flush with the case side. A recess in the interior of the case extends to the second exterior case side and is closed by a tab slidably mounted in the said second case side. The top and bottom exterior case sides are fitted with matching detents and recesses so that one case may be stacked on top of a second similar case in a non-slidable, but removable, configuration to form a fixed cabinet.

2 Claims, 6 Drawing Figures

DRAWER TYPE LUGGAGE

SUMMARY OF THE INVENTION

My invention is a portable carrying case fitted with a slidable drawer, with the front face of the drawer forming a first external side of the case in the closed drawer position and fitted on a second adjacent exterior side of the case with a retractable carrying handle that fits flush with the case side. A recess in the interior of the case extends to the second exterior case side and is closed by a tab slidably mounted in the said second case side. The top and bottom exterior case sides are fitted with matching detents and recesses so that one case may be stacked on top of a second similar case in a non-slidable, but removable, configuration to form a fixed cabinet.

As compared with conventional luggage in which members are mechanically joined or hinged together, the case and slidable drawer of the invention require no mechanical connection to each other, being held in place by a sliding fit. Consequently, each member and associated handle may be independently molded and assembled together without additional processing.

The use of molded plastic material for both case and drawer permit the design of a sealing fit between the drawer and the case for the storage and transport of liquids, providing improved security of contents and prevention of undesired loosening or opening of the drawer, than in the case of conventional hinged cases or luggage.

BRIEF DESCRIPTION OF THE DRAWINGS

The objects and features of the invention may be understood with reference to the following detailed description of an illustrative embodiment of the invention, taken together with the accompanying drawings in which.

Figure 1:
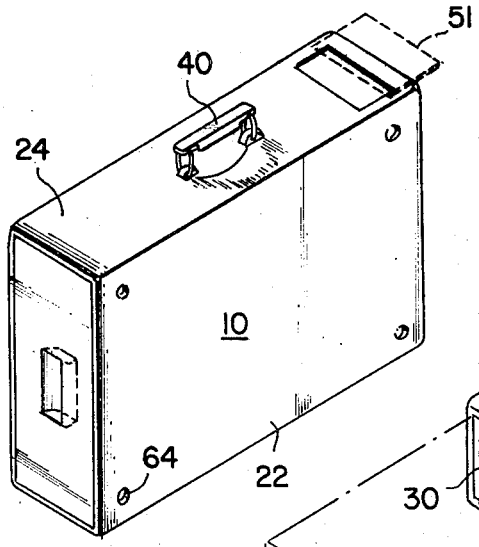
FIG. 1 is a perspective view of the invention employed as a portable carrying case.
Figure 2:
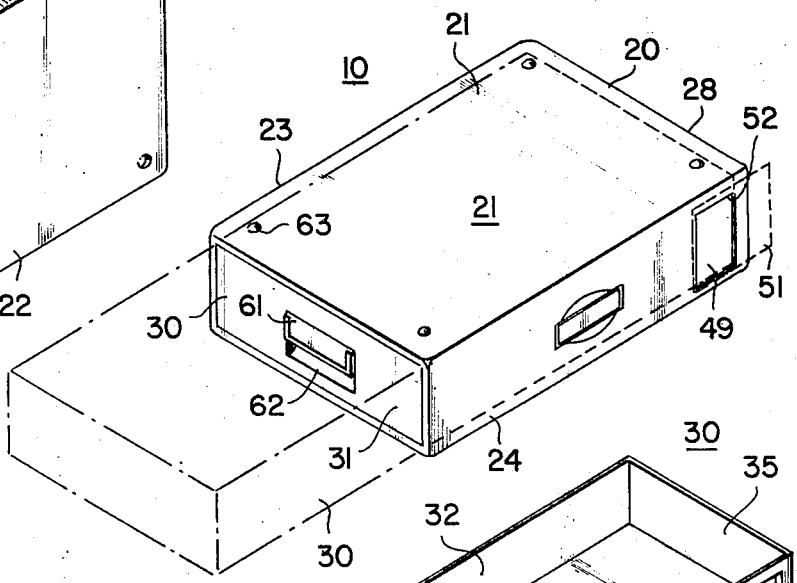
FIG. 2 is a perspective view of the invention employed as a file cabinet drawer.
Figure 6:
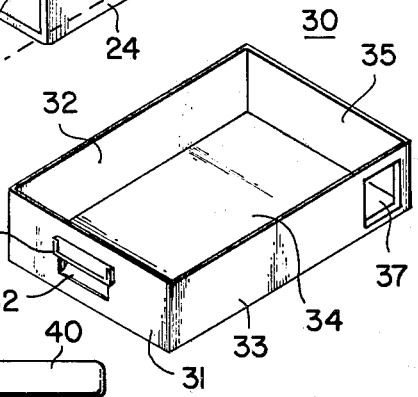
FIG. 6 is a perspective view of the case drawer.
Figure 3:
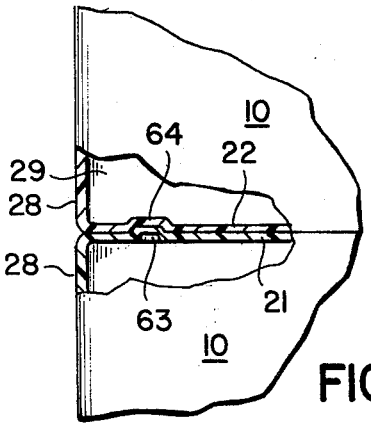
FIG. 3 is a detail sectional view of two drawers in stacked position.
Figure 4:
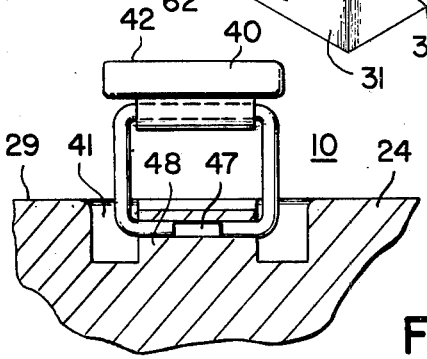
FIG. 4 is a detail end view of the case handle.

DESCRIPTION OF THE PREFERRED EMBODIMENT:

Turning now descriptively to the drawings in which similar reference characters denote similar elements throughout the several views, FIGS. 1-6 illustrate the case 10 which may be alternately employed as a portable carrying case and lifted by retractable handle 40 or as a fixed file cabinet with one case 10 mounted upon another case 10, as shown in FIG. 3.

The case body 20 is formed of a rectangular top wall 21 spaced from a rectangular bottom wall 22 by a pair of rectangular spaced side walls 23 and 24 which are joined to a rectangular rear wall 28, to bound an internal chamber 29.

A drawer 30 slidably fits in the interior recess 29 with drawer 30 formed of a front wall 31 joined to a pair of spaced side walls 32 and 33 and to a bottom wall 34, with a rear wall 35 joined to both side walls 32 and 33 and bottom wall 34. Front wall 31 of drawer 30 serves as the external front face of the case 10 in the closed position of drawer 30 in body 20.

Figure 5:
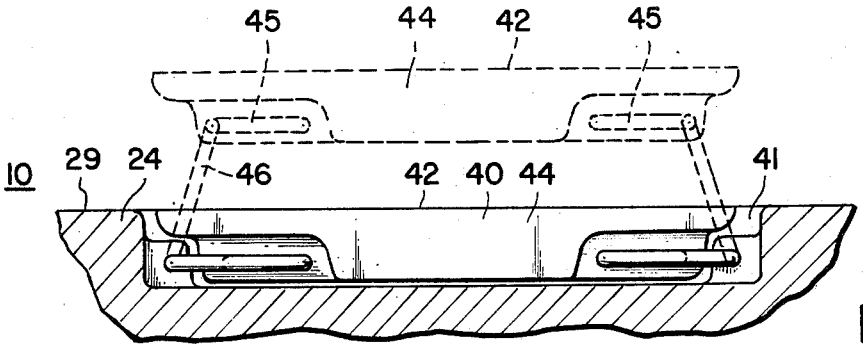
FIG. 5 is a detail side sectional view of the handle.

An external side wall 24 of the body 20 is fitted with a handle assembly 40 mountable in an external recess 41 of side wall 24 so that in the closed position of handle assembly 40, as shown in solid lines in FIG. 5, the exterior surface 42 of the handle assembly lies flush with the external surface 29 of side wall 24. As shown in the dash lines of FIG. 5, the grip member 44 may be extended beyond surface 39 of wall 24 for carrying purposes.

Handle assembly 40 is formed of a grip member 44 fitted at each end with a transverse slot 45 open at each side of grip member 44, with a link 46 slidably mounted in each slot 45 and individually hinged to a transverse pivot hole 47 in a projection 48 fitted in recess 41 to wall 24.

Drawer 30 is fitted with a through opening 37 in one side wall 33 which opening is aligned, in the closed drawer position, with a similar size opening 49 in a side wall 24 of the body 20. Opening 49 is closed by a tab member 51 slidably mounted in a slot 52 in wall 24 which slot 52 extends through the rear face of body 20, so that tab 51 may be slidably removed to expose opening 49, as shown in dash lines of FIG. 2, for manually placing small objects into drawer 30 or removing small objects out of the rear of drawer 30 in the closed position of the drawer, as shown in FIGS. 1 and 2.

The front wall 31 of drawer 30 is externally fitted with a bracket 61 for retention of an identification card and with a recessed grip section 62 for manually gripping drawer 30.

Upraised detents 63 are externally located on the top wall 21 of body 20 in aligned location with mating shaped recesses 64 located on the bottom wall 22 of body 20 so that two or more cases 10 may be stacked together in vertical orientation to form a fixed file cabinet with drawers 30 oriented to slide on a horizontal plane.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable carrying case which can be alternately employed as a file cabinet, comprising a drawer slidably mounted in a rectangular-shaped case body, with said case body formed with an interior recess extending from one open side of the case body, said drawer formed with a front wall that blocks the open side of the case body, in the closed position of the drawer in the case body, said drawer mounted to be slidable out of the open drawer of the case body, said drawer formed as an open box, the top of which drawer is open along a plane generally perpendicular to the said front wall of the drawer, with a through opening formed in a side wall of the drawer which side wall is generally mutually perpendicular to the plane of the said front wall and to the plane of the opening of the top of the drawer, said case body fitted with a retractable carrying handle mounted in an exterior recess in a wall of the case body, said handle fitting flush with, or below the external surface of the said case body wall in the retracted position of the handle, in which a through opening is formed in an exterior case body wall, which opening is oriented to be in alignment in the closed position of the drawer in the case body with the through opening in the side wall of the drawer, together with means to selectively close or open the said opening of the exterior case body wall.

2. The case of claim 1 fitted with recess and detent means to engage a plurality of said cases in a stacked array, said recess and detent means located such that when said cases are stacked, one above the other, the open side of each case body and the exterior case body wall formed with the through opening are each positioned on exterior sides of the said stacked array.

* * * * *